US009113665B2

(12) United States Patent
Torgersen

(10) Patent No.: US 9,113,665 B2
(45) Date of Patent: Aug. 25, 2015

(54) BUNTING BAG FOR CHILDREN

(71) Applicant: HTS Hans Torgersen & Sonn AS, Kroderen (NO)

(72) Inventor: Hans Kristian Torgersen, Kroderen (NO)

(73) Assignee: HTS Hans Torgersen & Sonn AS, Kroderen (NO)

( * ) Notice: Subject to any disclaimer, the term of this patent is extended or adjusted under 35 U.S.C. 154(b) by 52 days.

(21) Appl. No.: 13/754,941

(22) Filed: Jan. 31, 2013

(65) Prior Publication Data

US 2014/0033395 A1 Feb. 6, 2014

(30) Foreign Application Priority Data

Feb. 3, 2012 (NO) ..... 20120117

(51) Int. Cl.
*A41B 13/06* (2006.01)
*A41D 11/00* (2006.01)
*A47G 9/08* (2006.01)

(52) U.S. Cl.
CPC ..... *A41D 11/00* (2013.01); *A41B 13/06* (2013.01); *A47G 9/083* (2013.01)

(58) Field of Classification Search
CPC ..... A41D 11/00; A47G 9/08; A47G 9/083; A47G 9/086; A41B 13/06
USPC ..... 5/413 R, 416, 494; 2/69.5
See application file for complete search history.

(56) References Cited

U.S. PATENT DOCUMENTS

| | | | | |
|---|---|---|---|---|
| 2,374,299 | A * | 4/1945 | O'Hara | 2/69.5 |
| 3,304,556 | A * | 2/1967 | Meyers et al. | 2/69.5 |
| 4,103,377 | A * | 8/1978 | Mayer et al. | 2/69.5 |
| 4,989,282 | A | 2/1991 | Goldstein | |
| 5,560,043 | A * | 10/1996 | Armstrong | 2/69.5 |
| 7,650,655 | B2 * | 1/2010 | Narboni-Campora | 5/413 R |
| 2007/0028952 | A1 * | 2/2007 | Woodruff et al. | 135/96 |
| 2008/0148480 | A1 | 6/2008 | Narboni-Campora | |
| 2008/0235848 | A1 * | 10/2008 | Wilder et al. | 2/69.5 |
| 2009/0025118 | A1 | 1/2009 | Pothier | |
| 2009/0271909 | A1 * | 11/2009 | Hegland | 2/69.5 |
| 2012/0151654 | A1 * | 6/2012 | Chopak et al. | 2/69.5 |
| 2014/0033395 | A1 * | 2/2014 | Torgersen | 2/69.5 |

FOREIGN PATENT DOCUMENTS

| | | | |
|---|---|---|---|
| DE | 20 2005 006385 | | 7/2005 |
| DE | 20 2010 009824 | | 10/2010 |
| EP | 1396203 | A | 3/2004 |
| EP | 2622994 | A1 * | 8/2013 |
| GB | 24105 | | 0/1915 |
| NO | 322659 | A | 11/2006 |

* cited by examiner

*Primary Examiner* — Michael Trettel
(74) *Attorney, Agent, or Firm* — Christian Abel

(57) ABSTRACT

A bunting bag for children, where the bunting bag for children comprises a main part which is designed to be connected to a bottom part by means of a zipper, and a hood-shaped part containing an adjusting device. The bunting bag is opened and closed by means of a central closing and opening device, where the main part is provided on each side edge with a wind flap extending along the side edge and a lower wind flap extending round the main part's circumference, which wind flaps interact with a wind flap provided in the bottom part, forming a wind flap on an inner and outer side of the closing and opening device and the zipper, in order thereby to prevent through-flow of air through them.

12 Claims, 6 Drawing Sheets

BUNTING BAG FOR CHILDREN

FIELD OF THE INVENTION

The present invention relates in general to a bunting bag for children, and more particularly the present invention relates to a bunting bag for children, which is adjustable in both its longitudinal and width direction.

BACKGROUND OF THE INVENTION

The term bunting bag according to the present invention should be understood to refer to a thermally insulated textile object which is or may be made in the form of a bag in order to cover new-born babies and infants.

A bunting bag for children is generally provided with an elongated chamber or cavity inside the bunting bag and an opening at an upper end of the bunting bag. The bunting bag may furthermore be made of heat-insulating materials, thereby enabling it to be used in colder weather.

A bunting bag for children is generally designed so as to form an elongated chamber or cavity inside the bunting bag and an opening at an upper end of the bunting bag.

A great number of bunting bags for children are known, where the bunting bags are provided with a main part and a hood part. The bunting bags also comprise various adjusting devices for enabling the bunting bag to be better adapted to the child's size and/or use.

It is also known that bunting bags can be extended so as to be adapted to the child's growth, thereby permitting the bunting bag to be used over a longer period of time.

NO 317776 B1 and NO 323391 B1 show examples of such extendable bunting bags, where the bunting bag can be extended or shortened by folding a main part of the bunting bag or by replacing a lower part of the bunting bag with a new lower part which is shorter or longer.

The different adjusting devices in the known bunting bags may result in the bunting bag being wrongly adjusted and/or being used incorrectly, in addition to which there may be a considerable heat loss between one or more of the bunting bag's elements, particularly if these elements are connected by a zipper.

SUMMARY OF THE INVENTION

It is therefore an object of the present invention to provide a bunting bag for children, which can be adapted to fit the child, both in length and in width.

A further object according to the present invention will be to provide a bunting bag for children which is easy to use and which can easily be readjusted from one size to another.

These objects are achieved with a bunting bag for children according to the invention as specified in the following independent claim, where further features of the invention will become apparent from the dependent claims and the description below.

The bunting bag for children according to the present invention may also be employed as a sleeping bag or in connection with a pram. The bunting bag for children, however, will also be able to be employed as a base on which children can sit, lie or play, since a closing and opening device permits a main part of the bunting bag to be completely unfolded.

The present invention relates to a bunting bag for children comprising a main part which is designed to be able to be connected to a bottom part and a hood-shaped part arranged opposite the bottom part, where the hood-shaped part contains an adjusting device. The adjusting device in the hood-shaped part is used for tightening the hood-shaped part round the child's head, for example in colder weather, or for extending the hood-shaped part, in order thereby to provide a more open arrangement round the child's head. The bunting bag for children according to the present invention further comprises a central closing and opening device, whereby the main part can be unfolded in order to form a rug on which the child can sit, lie or play. Each side edge of the bunting bag's main part is further provided with a wind flap extending in the main part's longitudinal direction down to a lower end of the main part, where the wind flaps will form an inner and outer wind flap in the closing and opening device. In addition a lower wind flap is provided in the main part's lower end, extending round the main part's circumference (i.e. from side edge to side edge in the main part), and a zipper located inside the wind flap, arranged on an inside of the main part and extending substantially round the whole circumference of the main part. The bottom part which has to be connected to the bunting bag's main part will then be provided with a complementary zipper extending substantially round a whole circumference of the bottom part and a wind flap extending round the whole of the bottom part's circumference. When the bottom part is connected to the main part and the closing and opening device is closed, the wind flaps in the main part's side edges and lower end and the bottom part will be arranged on an inner and outer side of the closing and opening device and the zipper, in order thereby to prevent through-flow of air through them.

The term wind flap in the present invention should be understood to refer to a device which not only has to prevent cold air from flowing through the closing and opening device and the zipper, but which will also prevent heat from the interior of the bunting bag from flowing out through the same closing and opening device and zipper, in order thereby to insulate the bunting bag for children.

According to the present invention the closing and opening device will be composed of at least one zipper, which zipper can be opened from both its ends and closed from at least one end. It should be understood, however, that several sets of zippers may also be employed, and a person skilled in the art will know how this arrangement should be designed.

The adjusting device associated with the bunting bag's hood-shaped part comprises a channel which is arranged round a free edge (the outer edge) of the hood-shaped part, whereby the channel will extend from one side of the centrally-located closing and opening device, round the free edge to a second side of the closing and opening device. On the top of the hood-shaped part there is further provided a pocket or the like, in which pocket ends of two drawstrings may be inserted, in order thereby to conceal these from the child. A drawstring will therefore be placed on each side of the closing and opening device, where the drawstring will run through the channel up into the pocket on the top of the hood-shaped part.

In connection with the hood-shaped part there is also provided a tightening device on each side of the hood-shaped part, where the tightening device comprises an elastic drawstring and a quick-tightening device, quick-release fastener or the like which is connected to the elastic drawstring. The elastic drawstring will then be connected in a suitable manner to the edge of the hood-shaped part and may be arranged extending through a channel, in order thereby to protect the elastic drawstring. A pocket may furthermore be employed in order to conceal the elastic drawstring and quick-tightening device when they are not in use. The tightening devices are arranged on the bunting bag's hood-shaped part in such a manner that tightening of the tightening device will cause the hood-shaped part's width to be extended slightly in this area.

One of the tightening devices will be employed when the child has its head and nose facing the hood-shaped part's free edge, whereby tightening of the tightening device which the head and nose are facing will cause this part of the hood-shaped part's free edge to be pulled away from the child's nose.

The bunting bag for children according to the present invention may also be provided with one or more pockets, which pockets will then be placed in the bunting bag's main part. The pocket can be closed and opened by using a water- and windproof zipper. It should be understood, however, that the pocket may also be designed to be closed or opened by hook and loop fasteners, snap fasteners or the like.

On an inside of the outer wind flap in the bunting bag's main part, a number of cords with toggles may be provided, where these can be hooked into corresponding loops arranged at a certain distance from the main part's opposite side edge. This arrangement will be expedient when the bunting bag has to be adjusted slightly in width, in order thereby to bring the main part into closer contact with the child. In an embodiment of the present invention the cords with the toggles and the corresponding loops are arranged in an upper area of the bunting bag's main part, near the hood-shaped part. It should be understood, however, that these may be arranged in other areas, in addition to which several such sets of cords with toggles and corresponding loops may be arranged in the outer wind flap's longitudinal direction. In a lower area of the outer wind flap, a hook and loop fastener may also be provided which can be attached to a counterpart mounted on the opposite side of the main part's side edge, in order thereby to further secure the outer wind flap to the bunting bag's main part.

In an embodiment the outer wind flap in the bunting bag's main part may be tapered in shape from the hood-shaped part down to the lower end of the main part, where a reflector strip may furthermore be arranged round the whole or parts of the outer wind flap's edges.

Since the bottom parts employed for closing the bunting bag for children at a lower end are intended to be used to extend or shorten the length of the bunting bag, the bottom part will be provided in different lengths.

As a person skilled in the art will appreciate, the bunting bag for children according to the present invention may comprise the use of one or more fabric layers and insulating material between the fabric layers, depending on whether the bunting bag for children is intended to be a "summer bag" or a "winter bag". It will also be appreciated that the bunting bag for children according to the present invention may be designed to be able to be connected to one or more fabric layers, in order thereby to form a "summer- or winter bag" as required.

BRIEF DESCRIPTION OF THE DRAWINGS

Other advantages and special features of the present invention will become clear from the following detailed description, the attached drawings and the following claims, in which

DETAILED DESCRIPTION OF THE INVENTION

Figure 1:
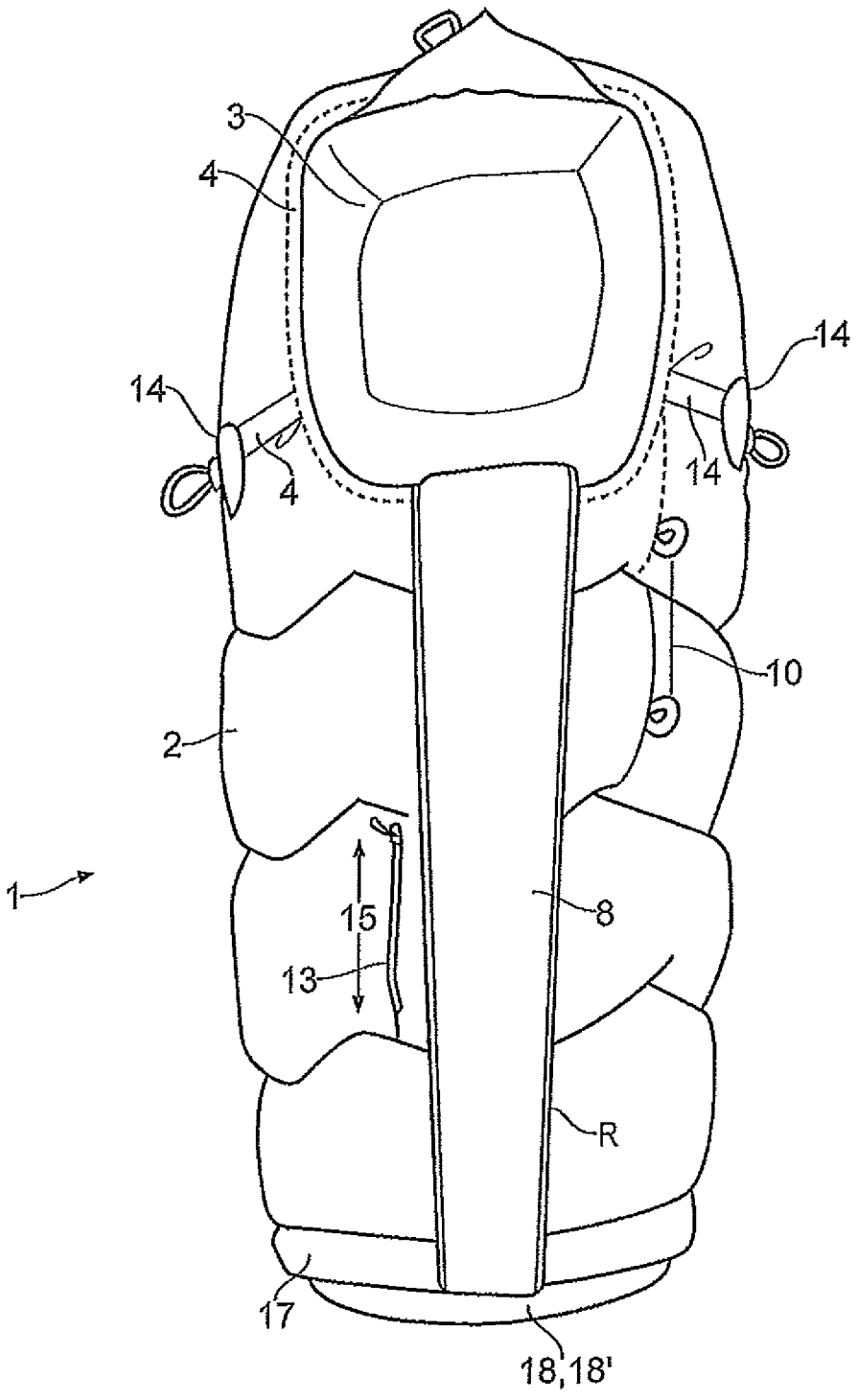
FIG. 1 illustrates a bunting bag for children according to the present invention, where the bunting bag is shown in a ready for use position.

FIG. 1 illustrates a bunting bag 1 for children according to the present invention, where the bunting bag 1 is depicted in a ready for use position. The bunting bag 1 for children comprises a bag-shaped main part 2 which is terminated at the upper end by a hood-shaped part 3. A free edge of the hood-shaped part 3 is provided with an adjusting device in the form of a channel 4 for drawstrings (not shown), where the drawstrings are used to enable the hood-shaped part 3 to be adjusted (tightened or loosened) around the child's head. The channel 4 will be arranged in such a manner that it extends from one side of a centrally located closing and opening device 5 (see also FIG. 2) in the bunting bag 1 for children, round the free edge of the hood-shaped part 3, whereupon it is terminated in a second side of the central closing and opening device 5. On the top of the hood-shaped part 3 a pocket 7 is provided for concealing the ends of the drawstrings. A drawstring will then run from each side of the closing and tightening device 5, through the channel 4 up to the pocket 7.

The central closing and opening device 5 comprises a zipper 6, where this zipper 6 is arranged on each side edge of the main part 2, extending in the main part's 2 longitudinal direction. The zipper may furthermore be opened from both its ends and closed from at least one end. By means of this arrangement the bunting bag's 1 main part 2 can be fully opened and completely unfolded, in order thereby to form a base on which the child can sit or play.

Figure 2:
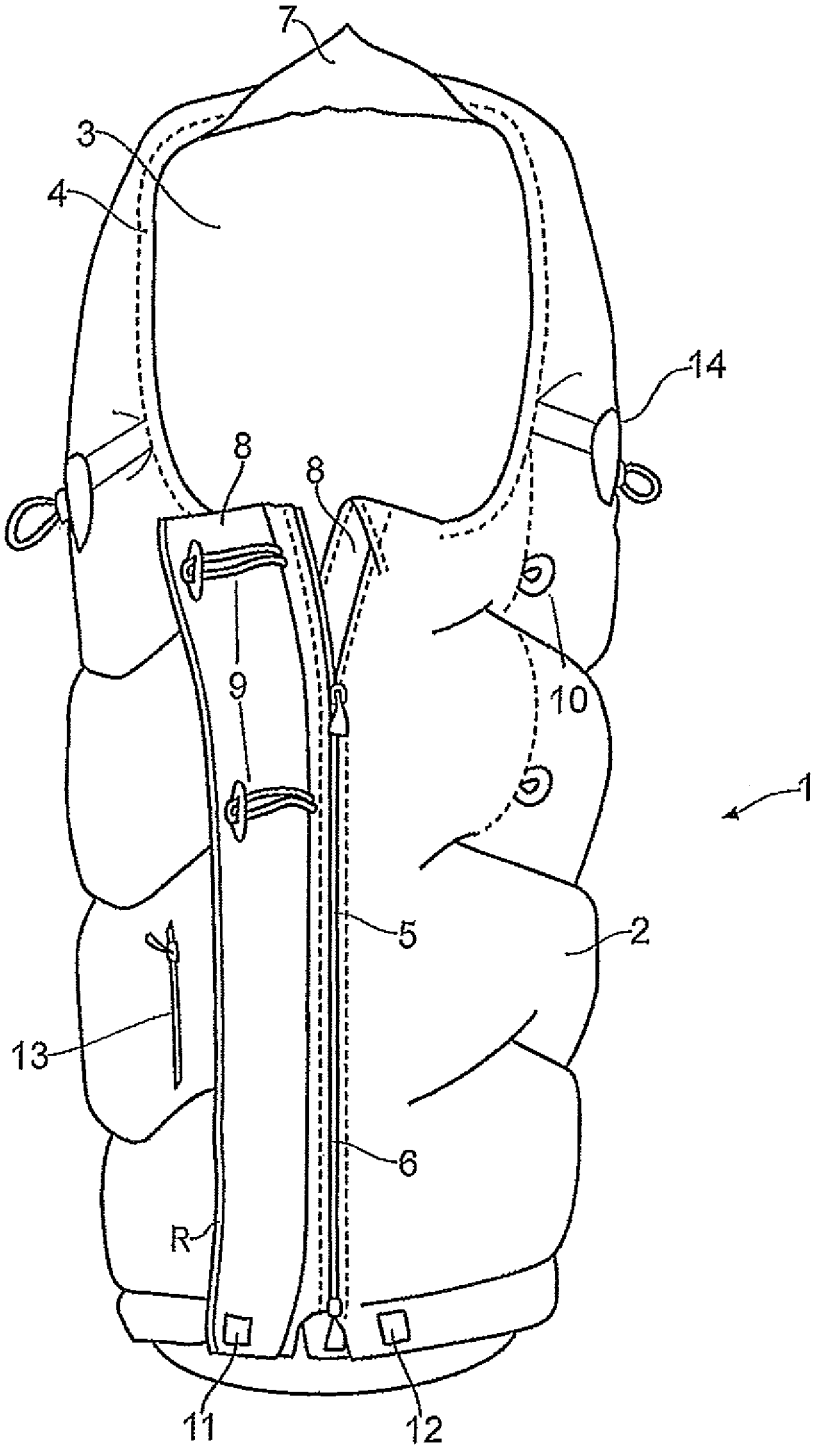
FIG. 2 illustrates details of the bunting bag's central closing and opening device.

Each side edge of the main part 2 is further provided with a wind flap 8, see also FIG. 2, so that the main part's 2 right side edge will form an inner wind flap, while the main part's 2 left side edge will form an outer wind flap. When the zipper 6 is closed (pulled up), the inner wind flap will be arranged between the child's body and the zipper 6, in order thereby to protect the child's body from cold wind. The outer wind flap will then be folded over the zipper 6, as illustrated in FIG. 1, in order to further prevent wind from blowing into the bunting bag through the zipper 6.

A reflector strip R is placed round at least a part of the outer wind flap.

On the inside of the outer wind flap there are further provided two cords with toggles 9, which can be hooked into corresponding loops 10 arranged at a distance from the main part's 2 opposite side edge. The cords with the toggles 9 and the corresponding loops 10 are used when the bunting bag has to be adjusted in its width direction, in order thereby to wrap the bunting bag more tightly round the child. The cords with the toggles 9 and the corresponding loops 10 are arranged in an upper area of the bunting bag's 1 main part 2, near the hood-shaped part 3. In the outer wind flap there is also provided a hook and loop fastener 11 which can be attached to a counterpart 12, in order thereby to secure the outer wind flap to the bunting bag's 1 main part 2.

A pocket 13 is provided in the bunting bag's 1 main part 2, which pocket 13 can be used for keeping keys, cards, wallet etc. when the bunting bag 1 is used. The pocket 13 may be equipped with a zipper, hook and loop fastener or the like for opening and closing the pocket 13.

At an opposite end of the hood-shaped part 3, the bunting bag's 1 main part 2 is designed to be able to be connected to a bottom part, so as to be able to close the bunting bag 1 at a lower end. This will be explained in more detail in connection with FIGS. 5 and 6.

In connection with the hood-shaped part 3 and the drawstrings, an additional tightening device 14 is provided on each side of the hood-shaped part 3. The tightening device 14 comprises an elastic drawstring and a quick-release fastener. The tightening devices 14 are arranged on the bunting bag's 1 hood-shaped part 3 in such a manner that tightening of the tightening device 14 will cause the hood-shaped part's 3 width to be extended slightly in this area. The tightening devices 14 will be employed when the child has its head and nose facing the hood-shaped part's 3 free edge, for example towards the right in FIG. 1, whereby a tightening of the tightening device 14 on the right side of this hood-shaped part 3 will cause the hood-shaped part's free edge in this area to be pulled away from the child's nose.

Figure 3:
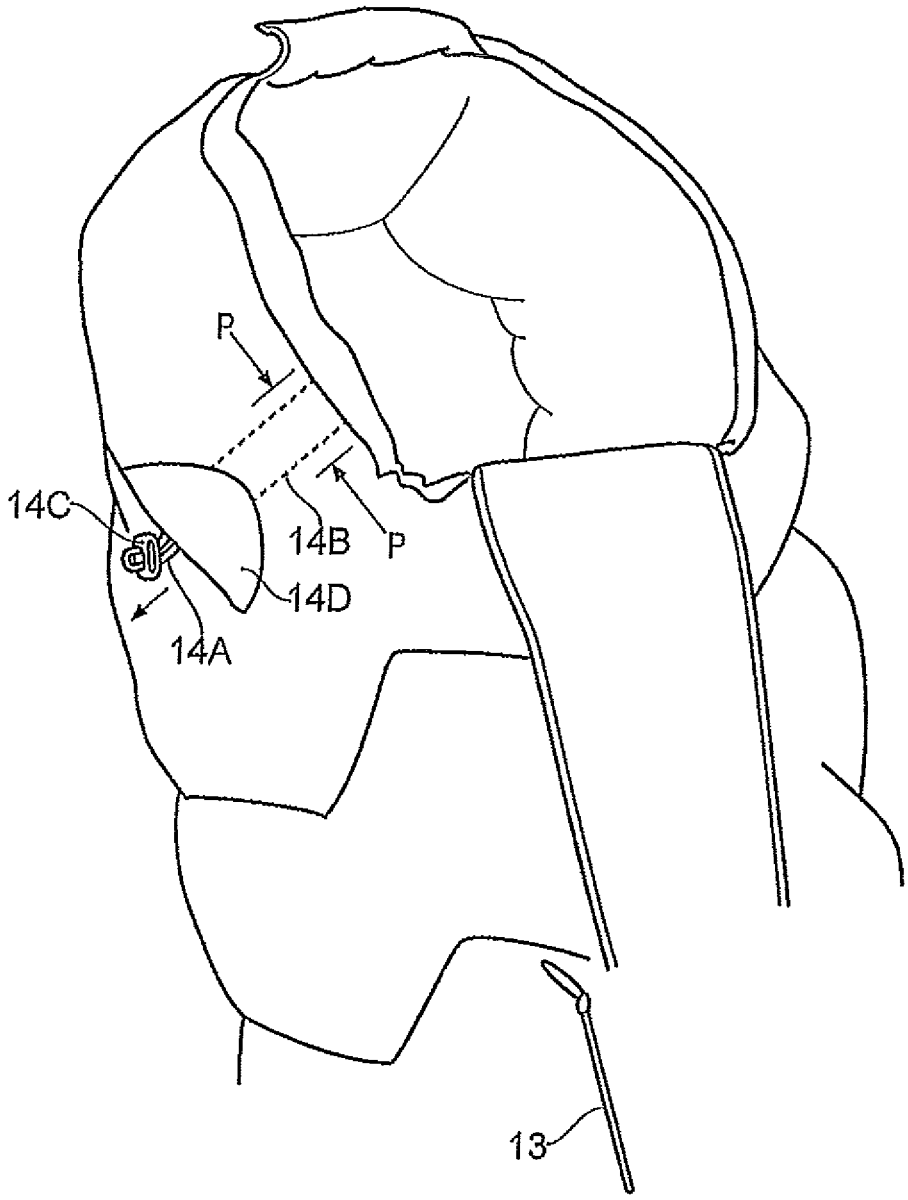
FIG. 3 illustrates a tightening device for the upper end of the bunting bag.

In FIG. 3 the tightening device 14 is illustrated in greater detail, where it can be seen that the tightening device 14 comprises an elastic drawstring 14A which is connected in a suitable manner to the hood-shaped part's 3 edge and passed through a channel 14B. At the end of the elastic drawstring 14A a quick-release fastener 14C is mounted. A pocket 14D is arranged overlapping a part of the channel 14B, in which pocket 14D the elastic drawstring 14A and the quick-release fastener 14C can be concealed when the tightening device 14 is not in use. When the elastic drawstring 14A is tightened, the hood part's 3 free edge will move in the direction of the arrows P, i.e. away from the child's nose.

Figure 4:
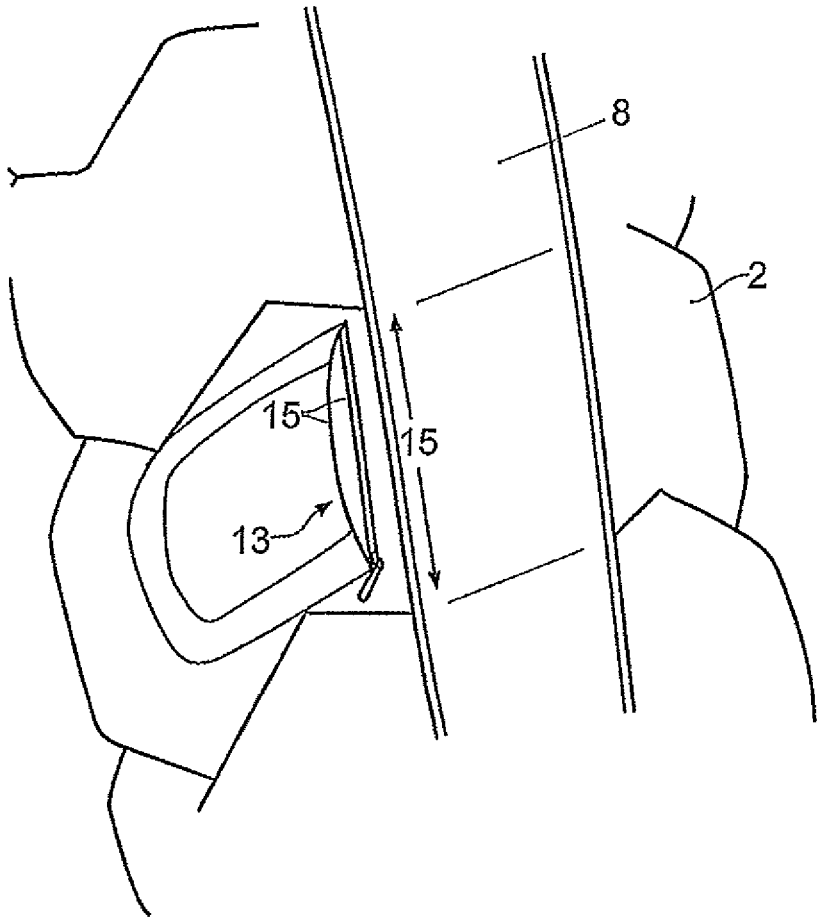
FIG. 4 illustrates a pocket which is integrated in the bunting bag.

FIG. 4 shows the pocket 13 which is provided in the bunting bag's 1 main part 2, where the pocket is designed to be able to be closed and opened by means of a water- and windproof zipper 15. However, a person skilled in the art will understand that the pocket 13 may also be designed to be closed by hook and loop, snap fasteners or the like.

Figure 5:
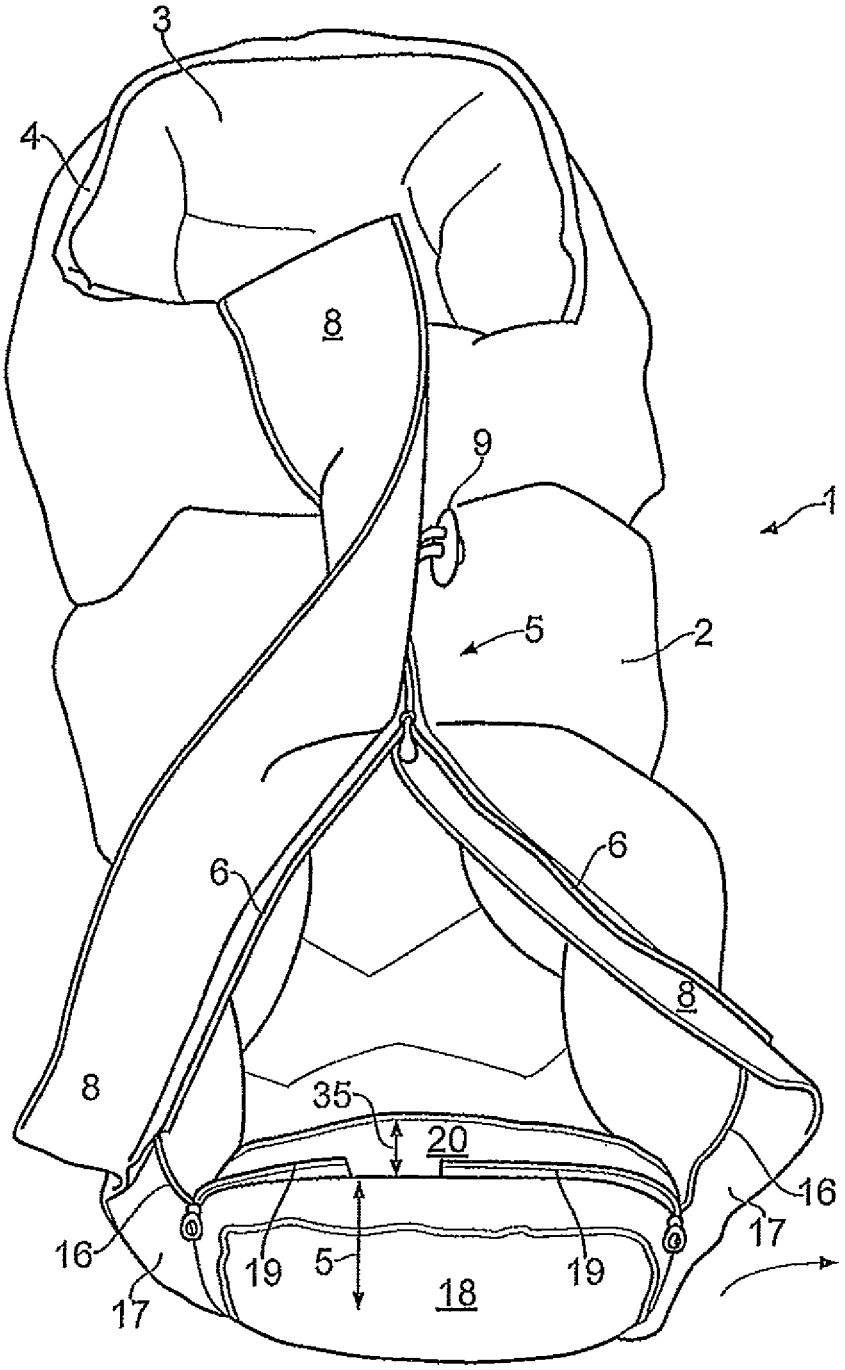
FIG. 5 illustrates the central closing and opening device partly open, revealing details of the lower end of the bunting bag.

FIG. 5 illustrates the design of the main part's 2 lower end, with a lower end of the bunting bag's 1 main part 2 pulled out to the sides, where it can be seen that a horizontal zipper 16 is mounted inside the main part 2, where this horizontal zipper 16 will extend substantially from side edge to side edge of the main part 2. The horizontal zipper 16 is furthermore arranged at a distance from the main part's 2 lower edge, thereby forming a lower wind flap 17. The horizontal zipper 16 is employed for connecting a bottom part 18 to the bunting bag's 1 main part 2, in order thereby to form a closed main part 2. The bottom part 18 which is in the form of an open "bag" will then also contain a zipper 19 which will extend substantially round a circumference of the bottom part, corresponding to the length of the horizontal zipper 16.

The bottom part 18 is also provided with a wind flap 20, which wind flap will extend round the whole circumference of the bottom part 18.

When the bottom part 18 is connected by means of the corresponding zippers 16, 19 to the bunting bag's 1 main part 2, the wind flap 20 will be arranged on the inside of the zippers 16, 19, while the lower wind flap 17 will then be arranged over the zippers 16, 19. The arrangement with the wind flaps 17, 20 will provide a far greater degree of protection against the infiltration of cold air into the bunting bag 1 for children through the area which is not covered by the zippers 16, 19 in the main part 2 and the bottom part 18.

Figure 6:
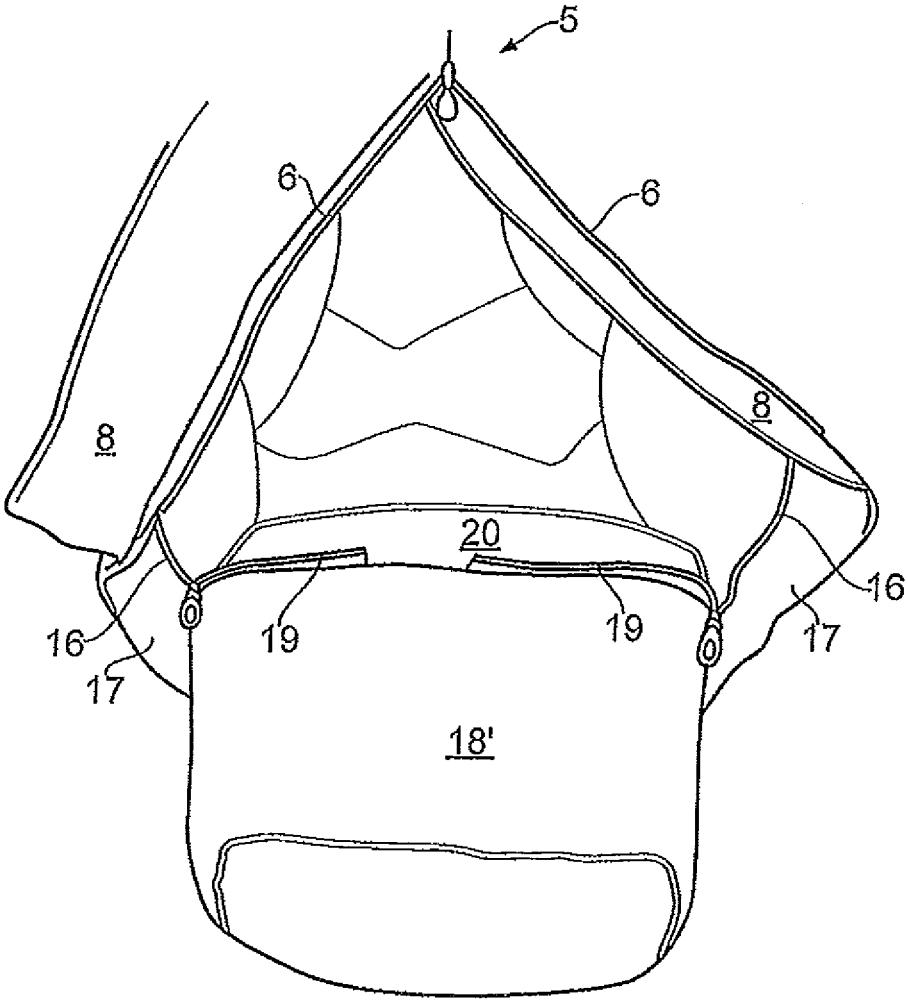
FIG. 6 illustrates an additional part which is employed when extending the bunting bag.

In FIG. 6 it is shown that the bunting bag's 1 main part 2 is partly connected to a second bottom part 18', in order thereby to extend the bunting bag 1 for children in the bunting bag's 1 longitudinal direction. In the same way as the bottom part 18, the bottom part 18' is in the form of an open bag, but will be "deeper" than the bottom part 18. Since the bottom part 18' is furthermore designed in the same way as the bottom part 18 (apart from the depth), we refer to FIG. 5 and the associated description of the bottom part 18.

The design of zippers 16, 19 and wind flaps 17, 20 on the main part 2 and the bottom part 18' will correspond to the description in FIG. 5 and we therefore refer to this description.

The present invention has now been explained in relation to an embodiment. However, a person skilled in the art will appreciate that a number of variations and modifications may be implemented of the bunting bag for children as described within the scope of the invention as it is defined in the attached claims. The bunting bag for children may therefore consist of one or more fabric layers, comprise the use of different insulating materials, be provided with several layers of zippers, designed to be able to function together with a pram's safety straps etc.

The invention claimed is:

1. A bunting bag (1) for children, comprising a main part (2) having side edges, the main part being designed to be connected to a bottom part (18, 18'), and a hood-shaped part (3) containing an adjusting device, which bunting bag (1) further comprises a central closing and opening device (5), wherein each side edge of the main part (2) is provided with a wind flap (8) extending in the main part's (2) longitudinal direction to a lower end of the main part (2), which wind flaps (8) form an inner and outer wind flap in the closing and opening device (5), and a lower wind flap (17) provided in the main part's (2) lower end and extending round a main part's (2) circumference, from side edge to side edge of the main part (2), where a zipper (16) is located inside the lower wind flap (17) and extending substantially round the circumference of the main part, characterised in that the bottom part (18, 18') is provided in different lengths, and each bottom part comprises a zipper (19) extending substantially round a circumference of the bottom part (18, 18') and an accompanying wind flap (20) arranged on an inner side of the zipper (19).

2. A bunting bag according to claim 1, characterised in that the closing and opening device (5) comprises at least one zipper (6), which zipper (6) can be opened from both its ends and closed from at least one end.

3. A bunting bag according to claim 1, characterised in that the adjusting device comprises a channel (4) arranged round the hood-shaped part's (3) free edge and drawstrings arranged therein.

4. A bunting bag according to claim 1, characterised in that the bunting bag comprises at least one closable and openable pocket (13) provided in the bunting bag's (1) main part (2).

5. A bunting bag according to claim 1, characterised in that a tightening device (14) is provided on opposite sides of the hood-shaped part (3).

6. A bunting bag according to claim 5, characterised in that the tightening device (14) comprises an elastic drawstring and a quick-release fastener mounted in a channel (4).

7. A bunting bag according to claim 3 or 5, characterised in that in connection with the adjusting device and the tightening device (14) a pocket (14D) is provided, in which pocket(s) drawstring(s) may be concealed.

8. A bunting bag according to claim 1, characterised in that on one of the main part's (2) side edges, in connection with the outer wind flap (8), a number of cords with toggles (9) are arranged, while an equivalent number of corresponding loops (10) are arranged at a distance from the main part's (2) opposite side edge.

9. A bunting bag according to claim 1,
characterised in that the bunting bag (1) comprises an outer and inner fabric layer.

10. A bunting bag according to claim 9,
characterised in that between the outer and inner fabric layer, at least over an area of these fabric layers, an insulating material is provided.

11. A bunting bag according to claim 1,
characterised in that the outer wind flap (8) is tapered in shape.

12. A bunting bag according to claim 11,
characterised in that around, at least over a part of a circumference of the outer wind flap (8) a reflector strip R is arranged.

* * * * *